US008807205B2

(12) United States Patent
Cunningham

(10) Patent No.: US 8,807,205 B2
(45) Date of Patent: Aug. 19, 2014

(54) GRAVEL PACKING APPARATUS HAVING A ROTATABLE SLURRY DELIVERY SUBASSEMBLY

(71) Applicant: Halliburton Energy Services, Inc., Houston, TX (US)

(72) Inventor: Gregory Scott Cunningham, Grapevine, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/945,561

(22) Filed: Jul. 18, 2013

(65) Prior Publication Data

US 2014/0110132 A1 Apr. 24, 2014

(30) Foreign Application Priority Data

Oct. 19, 2012 (WO) ..... PCT/US2012/061201

(51) Int. Cl.
*E21B 43/04* (2006.01)
*E21B 43/10* (2006.01)
*E21B 43/08* (2006.01)

(52) U.S. Cl.
CPC ..... *E21B 43/10* (2013.01); *E21B 43/086* (2013.01); *E21B 43/04* (2013.01)
USPC ..... 166/51; 166/278; 166/227

(58) Field of Classification Search
USPC ..... 166/51, 227, 278
See application file for complete search history.

(56) References Cited

U.S. PATENT DOCUMENTS

| | | | | |
|---|---|---|---|---|
| 7,784,532 | B2 * | 8/2010 | Sevre et al. | 166/51 |
| 2002/0125007 | A1 | 9/2002 | McGregor et al. | |
| 2002/0125009 | A1 | 9/2002 | Wetzel et al. | |
| 2003/0000699 | A1 | 1/2003 | Hailey | |
| 2009/0179383 | A1 * | 7/2009 | Koloy et al. | 277/338 |
| 2010/0236775 | A1 | 9/2010 | Sevre et al. | |
| 2012/0217010 | A1 | 8/2012 | Haeberle et al. | |
| 2013/0220635 | A1 * | 8/2013 | Greci et al. | 166/380 |

OTHER PUBLICATIONS

International Search Report and Written Opinion, KIPO, PCT/US2012/061201, Jul. 4, 2013.

* cited by examiner

*Primary Examiner* — Giovanna Wright
*Assistant Examiner* — Richard Alker
(74) *Attorney, Agent, or Firm* — Lawrence R. Youst

(57) ABSTRACT

A gravel packing assembly has first and second joints each including a sand control screen assembly having a filter medium positioned exteriorly of a base pipe and a slurry delivery subassembly rotatably mounted exteriorly on the sand control screen assembly. The slurry delivery subassembly includes at least one transport tube extending longitudinally along at least a portion of the sand control screen assembly. At least one jumper tube is coupled to and extends between the at least one transport tube of the first joint and the at least one transport tube of the second joint. The at least one transport tube of the first joint is axially aligned with the at least one transport tube of the second joint by rotating the slurry delivery subassembly of the first joint relative to the sand control screen of the first joint after the two joints are coupled together.

4 Claims, 7 Drawing Sheets

GRAVEL PACKING APPARATUS HAVING A ROTATABLE SLURRY DELIVERY SUBASSEMBLY

CROSS-REFERENCE TO RELATED APPLICATIONS

This application claims the benefit under 35 U.S.C. §119 of the filing date of International Application No. PCT/US2012/061201, filed Oct. 19, 2012.

TECHNICAL FIELD OF THE INVENTION

This invention relates, in general, to equipment utilized in conjunction with operations performed in relation to subterranean wells and, in particular, to a gravel packing apparatus having a rotatable slurry delivery subassembly and a method for assembling the gravel packing apparatus on the rig floor.

BACKGROUND OF THE INVENTION

Without limiting the scope of the present invention, its background is described with reference to a sand control completion in a wellbore traversing an unconsolidated or loosely consolidated subterranean formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as the tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use tubing positioned exteriorly along the length of the sand control screens to provide an alternate path for the fluid slurry around the sand bridge. It has been found, however, that it is difficult and time consuming to make all of the necessary fluid connections between the numerous alternate path tubing joints on the rig floor that are required for typical production intervals. Therefore, a need has arisen for an apparatus for gravel packing a production interval that overcomes the problems created by sand bridges. A need has also arisen for such an apparatus that is not difficult or time consuming to assemble on the rig floor.

SUMMARY OF THE INVENTION

The present invention disclosed herein is directed to a gravel packing apparatus having a rotatable slurry delivery subassembly for improved assembly of a gravel packing tool string on the rig floor. The gravel packing apparatus of the present invention is operable to overcome the problems created by sand bridges. In addition, the gravel packing apparatus of the present invention is not difficult or time consuming to assemble on the rig floor.

In one aspect, the present invention is directed to a gravel packing apparatus that includes a sand control screen assembly having a filter medium positioned exteriorly of a base pipe. The sand control screen assembly is operable to prevent the flow of particulate material of a predetermined size therethrough but allow the flow of production fluids therethrough. A slurry delivery subassembly is rotatably mounted exteriorly on the sand control screen assembly. The slurry delivery subassembly includes at least one transport tube extending longitudinally along at least a portion of the sand control screen assembly.

In one embodiment, the sand control screen assembly includes first and second circumferentially extending rails and the slurry delivery subassembly includes first and second ring assemblies. In this embodiment, the first ring assembly may be slidably positioned around the first rail and the second ring assembly may be slidably positioned around the second rail, thereby rotatably mounting the slurry delivery subassembly exteriorly on the sand control screen assembly. In another embodiment, the sand control screen assembly includes first and second threaded connectors and the slurry delivery subassembly includes first and second threaded ring assemblies. In this embodiment, the first threaded ring assembly may be threadably coupled to the first threaded connector and the second threaded ring assembly may be threadably coupled to the second threaded connector, thereby rotatably mounting the slurry delivery subassembly exteriorly on the sand control screen assembly.

In certain embodiments, a lock assembly may be positioned between the slurry delivery subassembly and the sand control screen assembly to selectively prevent relative rotation therebetween. The lock assembly may be one or more set screws, pins, a locking ring, a locking nut or the like. In some embodiments, an outer shroud may be positioned around the slurry delivery subassembly and the sand control screen assembly. In selected embodiments, the slurry delivery subassembly may include at least one packing tube having nozzles.

In another aspect, the present invention is directed to a gravel packing apparatus that includes first and second joints. Each joint includes a sand control screen assembly having a filter medium positioned exteriorly of a base pipe and a slurry delivery subassembly rotatably mounted exteriorly on the sand control screen assembly. The slurry delivery subassembly includes at least one transport tube extending longitudinally along at least a portion of the sand control screen assembly. At least one jumper tube is coupled to and extends between the at least one transport tube of the first joint and the at least one transport tube of the second joint. The at least one transport tube of the first joint is axially aligned with the at least one transport tube of the second joint by rotating the slurry delivery subassembly of the first joint relative to the sand control screen of the first joint after the sand control screen assembly of the first joint has been coupled to the sand control screen assembly of the second joint.

In another aspect, the present invention is directed to a method for assembling a gravel packing apparatus. The method includes providing first and second joints each including a sand control screen assembly having a filter medium positioned exteriorly of a base pipe and a slurry delivery subassembly rotatably mounted exteriorly on the sand control screen assembly, the slurry delivery subassembly including at least one transport tube extending longitudinally along at least a portion of the sand control screen assembly; threadably coupling the sand control screen assembly of the first joint to the sand control screen assembly of the second joint; axially aligning the at least one transport tube of the first joint with the at least one transport tube of the second joint by rotating the slurry delivery subassembly of the first joint relative to the sand control screen of the first joint; and coupling at least one jumper tube between the at least one transport tube of the first joint and the at least one transport tube of the second joint.

The method may also includes locking the slurry delivery subassembly of the second joint relative to the sand control screen of the second joint prior to axially aligning the at least one transport tube of the first joint with the at least one transport tube of the second join; locking the slurry delivery subassembly of the first joint relative to the sand control screen of the first joint after axially aligning the at least one transport tube of the first joint with the at least one transport tube of the second joint; sliding first and second ring assemblies of the slurry delivery subassembly on first and second rails of the sand control screen assembly; rotating first and second threaded ring assemblies of the slurry delivery subassembly on first and second threaded connectors of the sand control screen assembly; establishing fluid communication between the at least one transport tube of the first joint and the at least one transport tube of the second joint and/or sealably coupling the at least one jumper tube between the at least one transport tube of the first joint and the at least one transport tube of the second joint.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
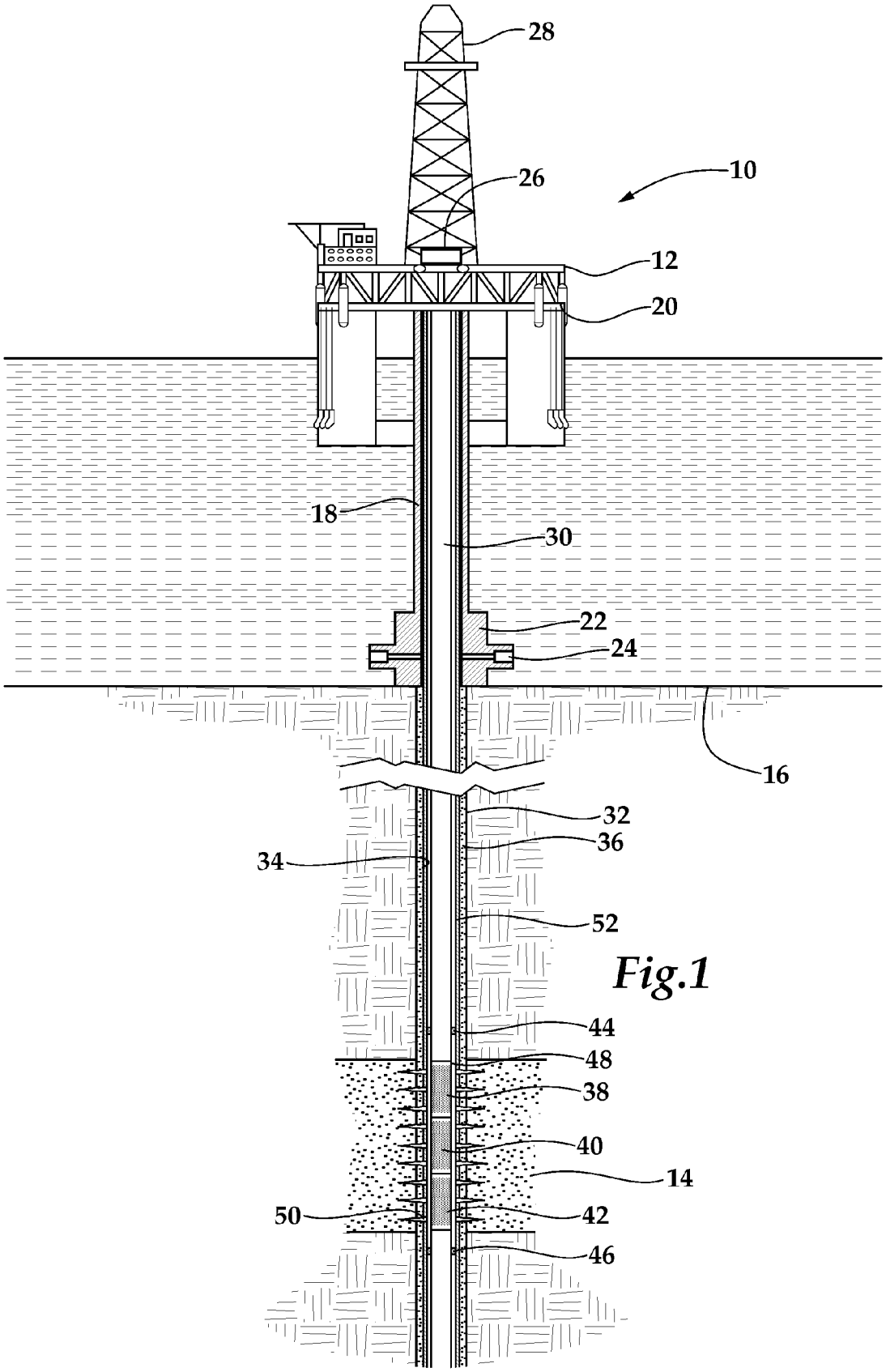
FIG. 1 is a schematic illustration of an offshore platform operating a gravel packing apparatus having a rotatable slurry delivery subassembly according to an embodiment of the present invention.

Referring initially to FIG. 1, a gravel packing apparatus positioned in an interval of a wellbore and operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is secured within wellbore 32 by cement 36. Work string 30 includes various tools including joints 38, 40, 42 that form the gravel packing apparatus of the present invention that is positioned in an interval of wellbore 32 adjacent to formation 14 between packers 44, 46. When it is desired to gravel pack annular region 48 surrounding joints 38, 40, 42, a fluid slurry including a liquid carrier and a particulate material such as sand, gravel or proppants is pumped down work string 30.

Some or all of the fluid slurry is typically injected directly into annular region 48 in a known manner, such as through a crossover tool (not pictured), which allows the slurry to travel from the interior of work string 30 to the exterior of work string 30. Once the fluid slurry is in annular region 48, a portion of the gravel in the fluid slurry is deposited in annular region 48. Some of the liquid carrier may enter formation 14 through perforation 50 while the remainder of the fluid carrier along with some of the gravel enters certain sections of joints 38, 40, 42 filling those sections with gravel. The sand control screens within joints 38, 40, 42 disallows further migration of the gravel but allows the liquid carrier to travel therethrough into work string 30 and up to the surface via annulus 52. If sand bridges form in annular region 48, some or all of the fluid slurry is injected or diverted into the slurry delivery subassemblies within joints 38, 40, 42 to bypass the sand bridge such that a complete pack can be achieved.

Even though FIG. 1 depicts the gravel packing apparatus of the present invention in a vertical wellbore, it should be understood by those skilled in the art that the gravel packing apparatus of the present invention is equally well suited for use in wellbores having other directional configurations including horizontal wellbores, deviated wellbores, slanted wells, lateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an offshore operation, it should be noted by those skilled in the art that the gravel packing apparatus of the present invention is equally well-suited for use in onshore operations. Further, even though FIG. 1 depicts the gravel packing apparatus of the present invention as having a particular number of joints, it should be understood by those skilled in the art that a gravel packing apparatus of the present invention may have any number of joints both less than or greater than the number shown.

Figure 2:
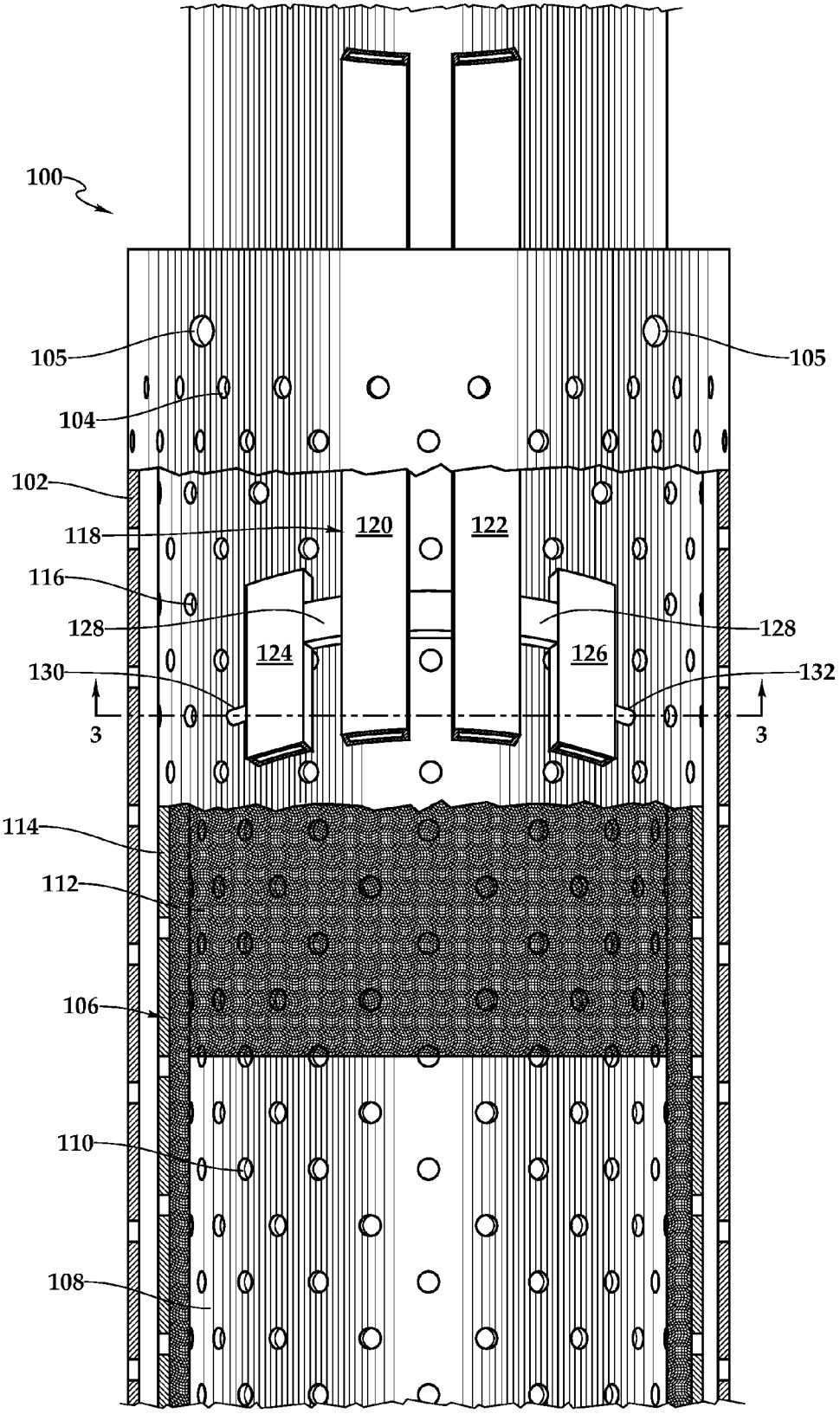
FIG. 2 is a side view partially in cut away of a gravel packing apparatus having a rotatable slurry delivery subassembly according to an embodiment of the present invention.

Referring next to FIG. 2, therein is depicted a cut away view of a portion of a gravel packing apparatus of the present invention that is generally designated 100. Apparatus 100 has an outer tubular or shroud 102 that includes a plurality of openings 104 that are substantially evenly distributed around and along the length of outer tubular 102, which allow the flow of production fluids therethrough. Shroud 102 also includes a pair of access ports 105, each of which aligns with a locking assembly as described below to allow operations thereof. Disposed within outer tubular 102 is a sand control screen assembly 106. Sand control screen assembly 106 includes a base pipe 108 that has a plurality of openings 110 which allow the flow of production fluids into the production tubing. The exact number, size and shape of openings 110 are not critical to the present invention, so long as sufficient area is provided for fluid production and the integrity of base pipe 108 is maintained.

Positioned around base pipe 108 is a filter medium depicted as a fluid-porous, particulate restricting wire mesh screen 112. Screen 112 is designed to allow fluid flow therethrough but prevent the flow of particulate materials of a predetermined size from passing therethrough. Screen 112 preferably has a plurality of layers of wire mesh including one or more drainage layers and one or more filter layers wherein the drainage layers that have a mesh size that is larger than the mesh size of the filter layers. For example, a drainage layer may preferably be positioned as the outermost layer and the innermost layer of wire mesh screen 112 with the filter layer or layers positioned therebetween. Positioned around screen 112 is a screen wrapper 114 that has a plurality of openings 116 which allow the flow of production fluids therethrough. The exact number, size and shape of openings 116 is not critical to the present invention, so long as sufficient area is provided for fluid production and the integrity of screen wrapper 114 is maintained. Typically, various sections of screen 112 and screen wrapper 114 are manufactured together as a unit by, for example, diffusion bonding or sintering the layers of wire mesh that form screen 112 together with screen wrapper 114, then rolling the unit into a tubular configuration. The two ends of the tubular unit are then seam welded together. Several tubular units of the screen and screen wrapper combination may be placed over each joint of base pipe 108 and secured thereto by welding or other suitable technique. It should be understood by those skilled in the art that even though FIG. 2 has described a particular filter medium, other types of filter media could alternatively be used in conjunction with the apparatus of the present invention, including, but not limited to, a wire wrapped sand control screen.

Disposed between outer tubular 102 and sand control screen assembly 106 is a slurry delivery subassembly 118. In the illustrated embodiment, slurry delivery subassembly 118 includes a pair of transport tubes 120, 122, a pair of packing tubes 124, 126 and a manifold 128 that provides fluid communication between transport tubes 120, 122 and packing tubes 124, 126. As illustrated, transport tubes 120, 122 extend longitudinally past outer tubular 102 such that the transport tubes 120, 122 of one joint can be fluidically coupled to the transport tubes 120, 122 of another joint as explained in greater detail below. Packing tubes 124, 126 each include a plurality of nozzles, such as nozzle 130 of packing tube 124 and nozzle 132 of packing tube 126. In the event of sand bridge formation or as part of a planned gravel packing process, some or all of the fluid slurry is injected into the slurry delivery subassembly 118 of the uppermost joint. The fluid slurry is able to travel from one joint to the next via the transport tubes 120, 122. As the fluid slurry travels from joint to joint, portions of the fluid slurry enter packing tubes 124, 126 via manifold 128. From packing tubes 124, 126, the fluid slurry is able to enter the annular region surrounding gravel packing apparatus 100 by exiting slurry delivery subassembly 118 via nozzles 130, 132. In this manner, a complete gravel pack may be achieved even if sand bridges form in the annular region surrounding gravel packing apparatus 100.

Figure 3:
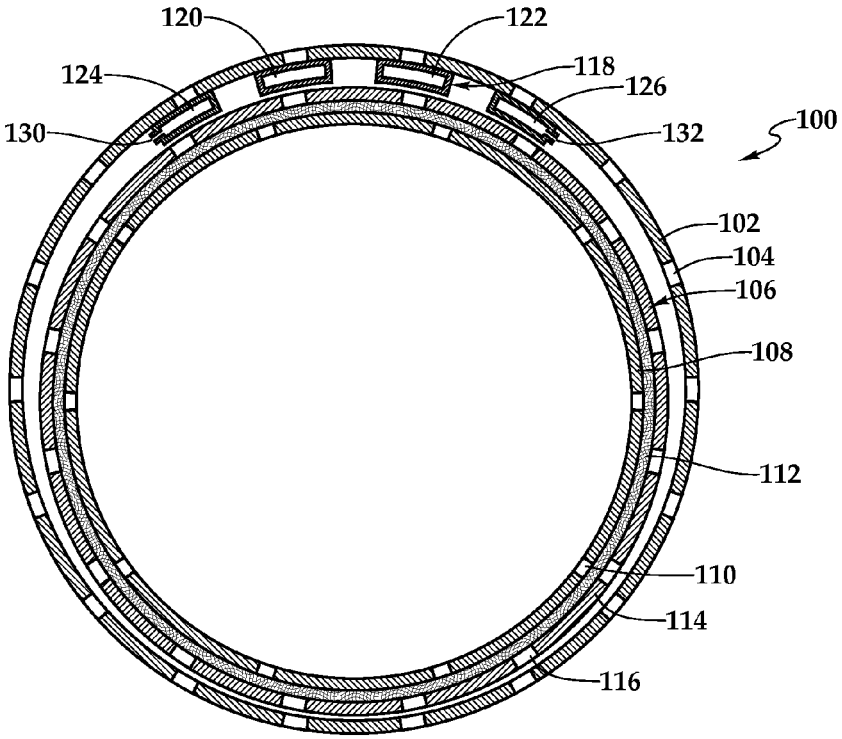
FIG. 3 is a cross sectional view of a gravel packing apparatus having a rotatable slurry delivery subassembly according to an embodiment of the present invention.
Figure 4:
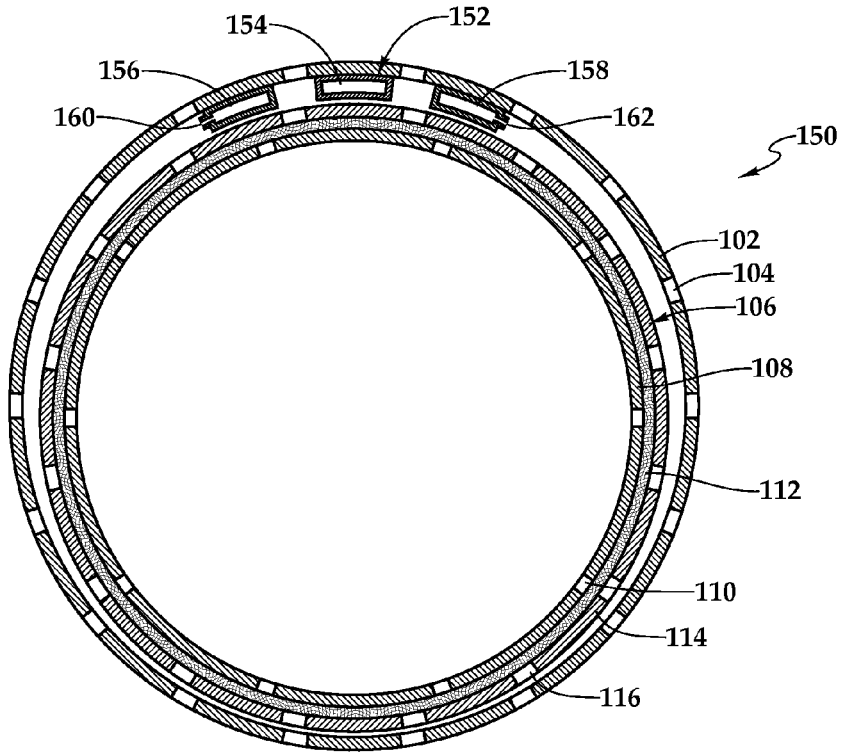
FIG. 4 is a cross sectional view of a gravel packing apparatus having a rotatable slurry delivery subassembly according to an embodiment of the present invention.
Figure 5:
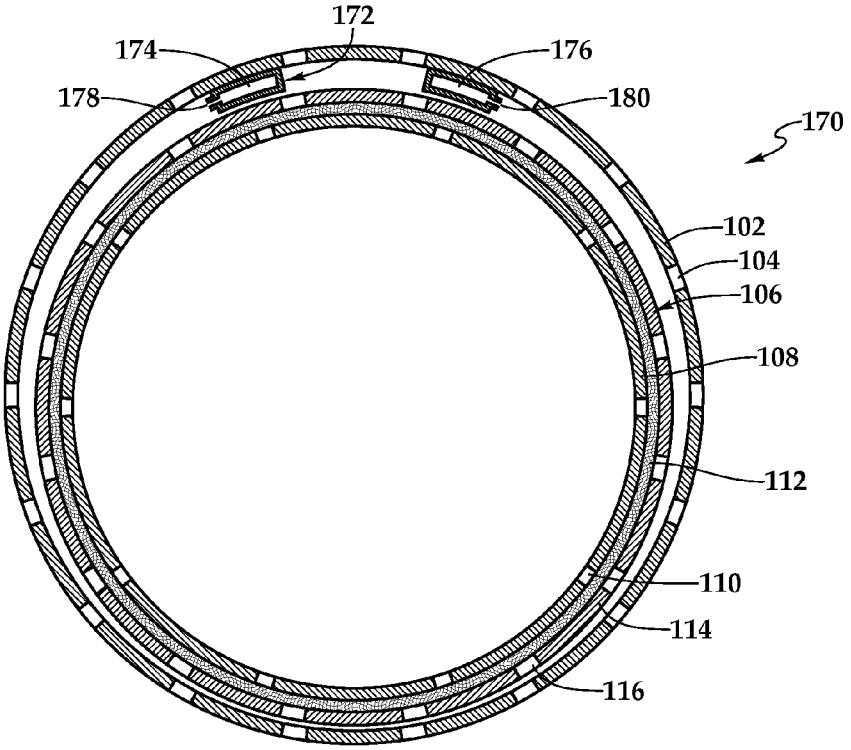
FIG. 5 is a cross sectional view of a gravel packing apparatus having a rotatable slurry delivery subassembly according to an embodiment of the present invention.
Figure 6:
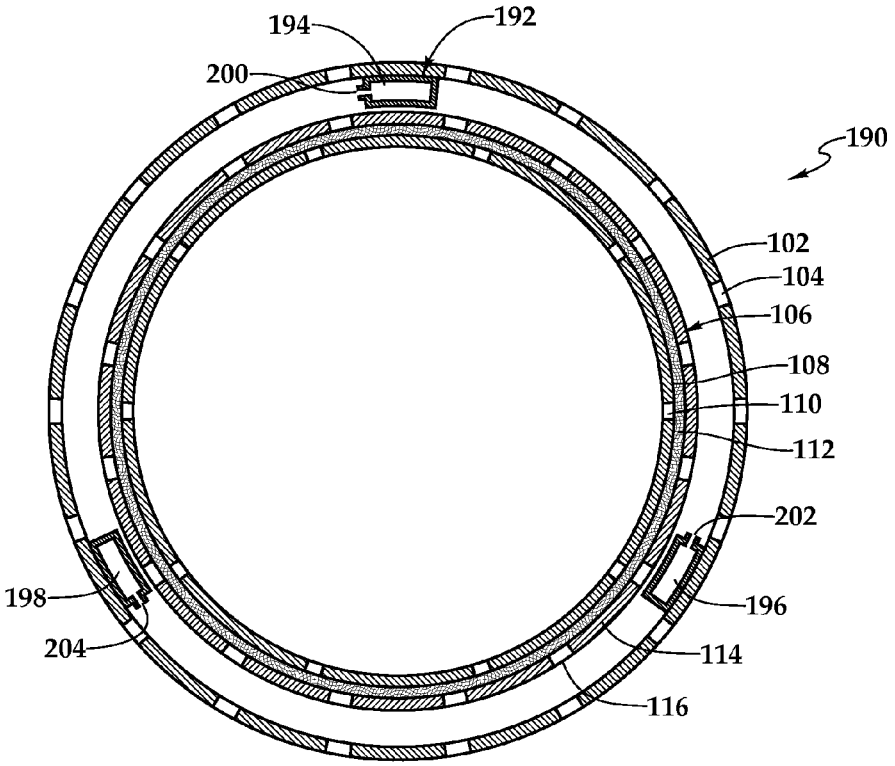
FIG. 6 is a cross sectional view of a gravel packing apparatus having a rotatable slurry delivery subassembly according to an embodiment of the present invention.

As best seen in FIG. 3, sand control screen assembly 106 may be eccentrically positioned within outer tubular 102 to enable slurry delivery subassembly 118 to be positioned therebetween while maintaining a desired outer diameter of gravel packing apparatus 100. It should be understood by those skilled in the art, however, that even though FIGS. 2 and 3 have described a particular slurry delivery subassembly, other slurry delivery subassembly having other configurations could alternatively be used in conjunction with the apparatus of the present invention. For example, as best seen in FIG. 4, a gravel packing apparatus 150 is depicted having a slurry delivery subassembly 152 including a single transport tube 154 and a pair of packing tubes 156, 158 each having a plurality of nozzles 160, 162 in an eccentric design. In another example, as best seen in FIG. 5, a gravel packing apparatus 170 is depicted having a slurry delivery subassembly 172 including a pair of slurry delivery tubes 174, 176 that serve as both transport tubes, as they extend from joint to joint, as well as packing tubes, as each has a plurality of nozzles 178, 180. Gravel packing apparatus 170 also has an eccentric design. In a further example, as best seen in FIG. 6, a gravel packing apparatus 190 is depicted having a slurry delivery subassembly 192 including three slurry delivery tubes 194, 196, 198 that serve as both transport tubes, as they extend from joint to joint, as well as packing tubes, as each has a plurality of nozzles 200, 202, 204. Unlike the previously described gravel packing apparatuses, gravel packing apparatus 190 has a concentric design wherein sand control screen assembly 106 is concentrically positioned within the outer tubular 102 with slurry delivery tubes 194, 196, 198 circumferentially distributed therebetween.

Figure 7:
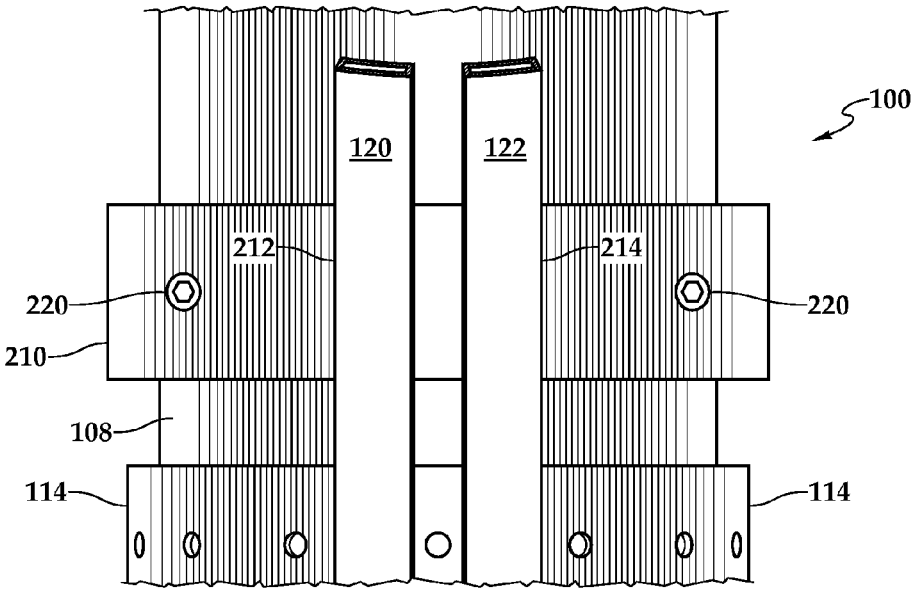
FIG. 7 is a side view of a portion of a gravel packing apparatus having a rotatable slurry delivery subassembly according to an embodiment of the present invention with the outer shroud removed.

Referring now to FIG. 7, an upper portion of a joint of gravel packing apparatus 100 is depicted with the outer shroud 102 removed. In the illustrated portion, transport tubes 120, 122 are rotatably mounted to base pipe 108 with a ring assembly 210. Ring assembly 210 has a pair of outer slots 212, 214 that receive and support transport tubes 120, 122. It should be noted that the lower end of transport tubes 120, 122 is also received and supported in a similar ring assembly. In addition, one or more ring assemblies could be positioned along transport tubes 120, 122 between the two ends such as in a location between adjacent screen jackets located on a single base pipe. Depending upon the configuration of the gravel packing apparatus, ring assembly 210 may have an eccentric or concentric design. For example, a ring assembly for use in gravel packing apparatus 100 of FIG. 3 would preferably be eccentric such that it is operable to receive and support transport tubes 120, 122 but is relatively thin on its opposite side. A ring assembly for use in gravel packing apparatus 190 of FIG. 6, however, would preferably be concentric such that it is operable to receive and support slurry delivery tubes 194, 196, 198 uniformly around gravel packing apparatus 190. Ring assembly 210 may be a single solid ring or may be formed from ring sections that substantially form a solid ring or may form a segmented ring having gaps between the ring sections, such ring sections suitable secured together with a connecting rods or similar coupling member.

It should be understood by those skilled in the art that even though transport tubes 120, 122 are depicted as being received and supported in outer slots 212, 214 of ring assembly 210, transport tubes may cooperate with a ring assembly in alternate ways, including, but not limited to, extending through openings in a ring assembly, extending only partially into openings of a ring assembly or otherwise being fluidically coupled to one side of a ring assembly wherein the openings of the ring assembly become part of a fluid path for the fluid slurry. In such an embodiment, the jumper tubes that fluidically couple the transport tubes of one joint with the transport tubes of the adjacent joint are similarly partially inserted into the openings of the ring assembly or otherwise fluidically coupled to the other side of the ring assembly.

Figure 8:
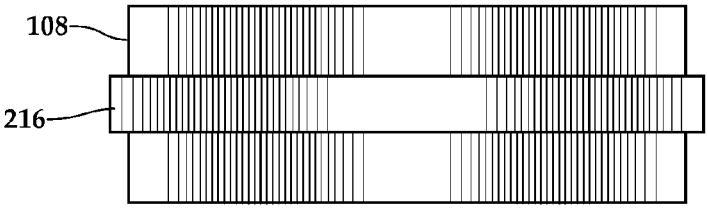
FIG. 8 is a side view of a connector including a rail operable for use in a gravel packing apparatus having a rotatable slurry delivery subassembly according to an embodiment of the present invention.
Figure 10:
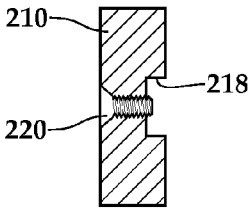
FIG. 10 is a cross sectional view of a ring assembly for use in a gravel packing apparatus having a rotatable slurry delivery subassembly according to an embodiment of the present invention.

As best seen in FIG. 8, base pipe 108 includes a circumferentially extending rail 216. Rail 216 may extend 360 degrees about base pipe 108 or may be formed in segments having gaps therebetween. Alternatively, rail 216 may extend only partially around base pipe 108 leaving a gap between the two ends of rail 216. As best seen in FIG. 10, ring assembly 210 may have a slot 218 that is operable to cooperate with rail 216 enabling ring assembly 210 to rotate about base pipe 108. Ring assembly 210 may be installed in circumferential sections on rail 216 such as in two or more sections that fit together over rail 216 and are then connected to one another by welding, bolting or other suitable technique. Alternatively, in embodiments having a rail 216 that extends only partially around base pipe 108, circumferential sections of ring assembly 210 may be inserted in the gap between the ends of rail 216 then slid onto rail 216 with additional sections of ring assembly 210 installed in a similar manner and coupled together until the entire ring assembly 210 is formed. In ether case, once ring assembly 210 is installed, along with slurry delivery subassembly 118 and outer tubular 102, this unit is able to rotate relative to base pipe 108. This rotation enables the transport tubes 120, 122 of one joint to be axially aligned with the transport tubes 120, 122 of another joint to aid in the assembly of gravel packing apparatus 100 on the rig floor as gravel packing apparatus 100 is being installed in the well. Once transport tubes 120, 122 in adjacent joints have been aligned, further rotation is not desirable. Gravel packing apparatus 100 includes a locking assembly depicted as set screws 220, as best seen in FIGS. 7 and 10. Set screws 220 may be operated through access ports 105 of shroud 102.

Figure 11:
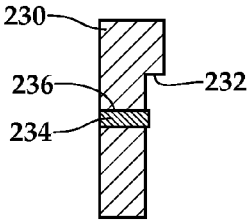
FIG. 11 is a cross sectional view of a ring assembly for use in a gravel packing apparatus having a rotatable slurry delivery subassembly according to an embodiment of the present invention.

It should be understood by those skilled in the art that even though FIGS. 7 and 10 have described a particular ring assembly, other ring assemblies having other configurations could alternatively be used in conjunction with the apparatus of the present invention. For example, as best seen in FIG. 11, ring assembly 230 has a shoulder 232 that cooperates with rail 216 of base pipe 108. In addition, the lock assembly of ring assembly 230 is depicted as a pin 234 that may have a friction fit within an opening 236 of ring assembly 230 and may be operated through access ports 105 of shroud 102. In using ring assemblies 230, shoulder 232 of ring assembly 230 on the upper end of the joint should be oppositely disposed relative to shoulder 232 of ring assembly 230 on the lower end of the joint to prevent axial movement of slurry delivery subassembly 118 and outer tubular 102 relative to sand control screen assembly 106.

Figure 9:
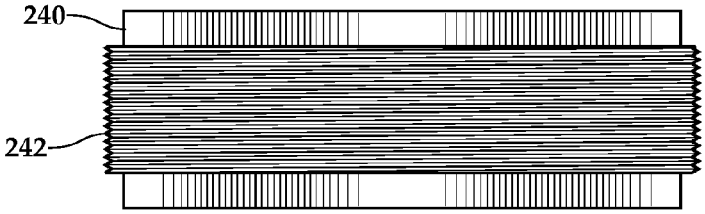
FIG. 9 is a side view of a threaded connector operable for use in a gravel packing apparatus having a rotatable slurry delivery subassembly according to an embodiment of the present invention.
Figure 12:
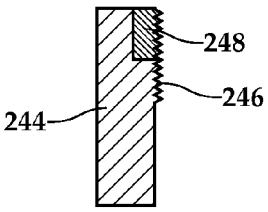
FIG. 12 is a cross sectional view of a ring assembly for use in a gravel packing apparatus having a rotatable slurry delivery subassembly according to an embodiment of the present invention.

In FIGS. 9 and 12, an alternate embodiment of a rotatable connection between slurry delivery subassembly 118 and outer tubular 102 relative to sand control screen assembly 106 is depicted. As best seen in FIG. 9, base pipe 240 includes a circumferentially extending threaded connector 242. As best seen in FIG. 12, a ring assembly 244 includes a threaded inner portion 246 that cooperates with threaded connector 242 enabling ring assembly 244, along with slurry delivery subassembly 118 and outer tubular 102, to rotate about sand control screen assembly 106. This rotation enables the transport tubes 120, 122 of the slurry delivery subassembly 118 of one joint to be axially aligned with the transport tubes 120, 122 of the slurry delivery subassembly 118 of another joint to aid in the assembly of gravel packing apparatus 100 on the rig floor as gravel packing apparatus 100 is being installed in the well. Once transport tubes 120, 122 in adjacent joints have been aligned, further rotation is not desirable. The achieve this result, a locking assembly depicted as a threaded locking ring or nut 248 is provided that may be tightened against ring assembly 244 to prevent rotation thereof.

Figure 13A:
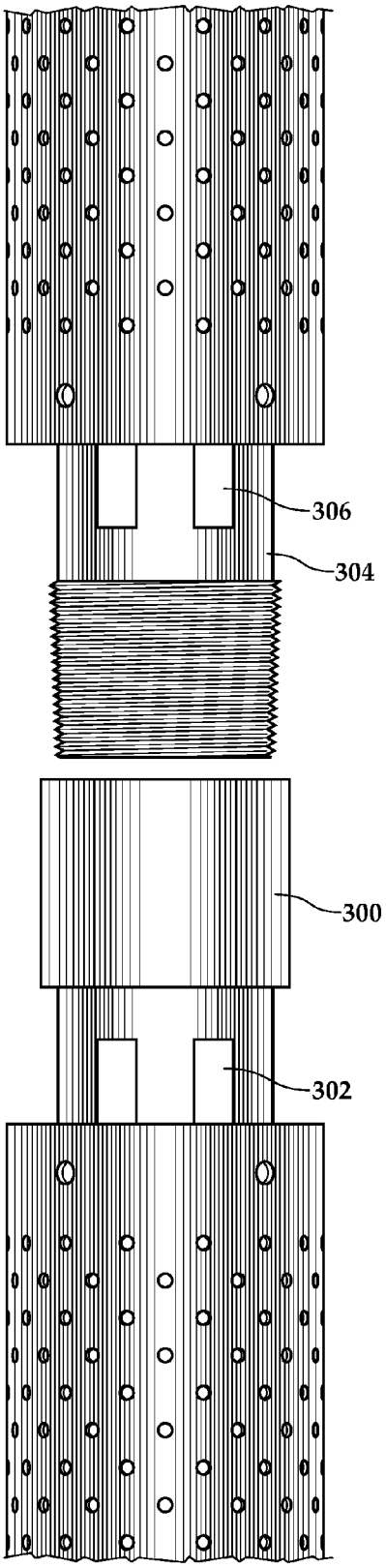
FIGS. 13A-13D are schematic illustration of the process of coupling two joints of a gravel packing apparatus having a rotatable slurry delivery subassembly according to an embodiment of the present invention.
Figure 13B:
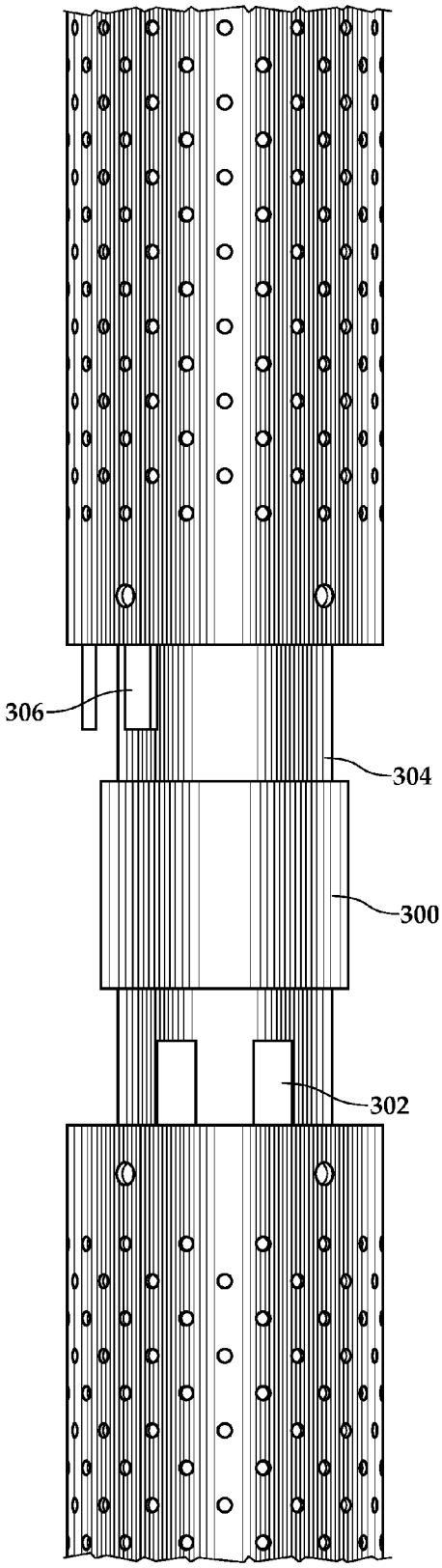
Figure 13C:
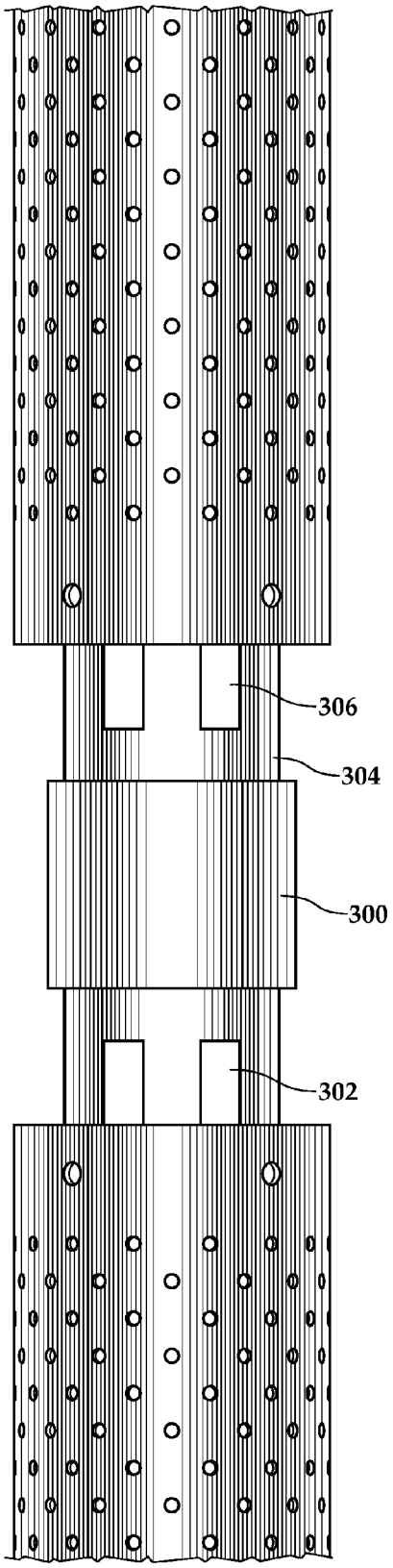
Figure 13D:
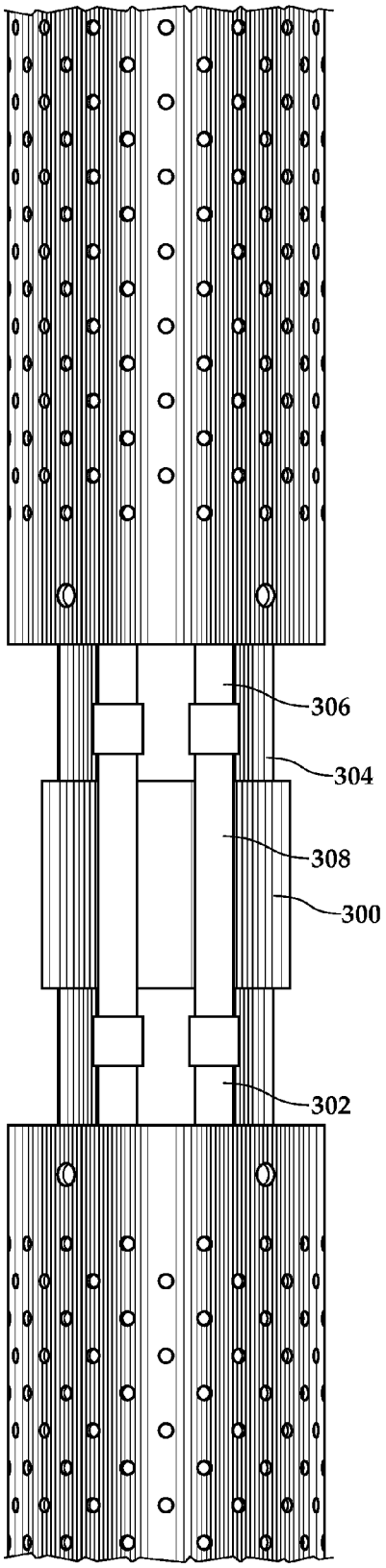

The operation of assembling the gravel packing apparatus of the present invention will now be described with reference to FIGS. 13A-13D. A lower joint of the gravel packing apparatus is depicted as joint 300 having a pair of transport tubes 302. Joint 300 is supported by the well platform in, for example, a screen table assembly attached to the rotary table generally located on the well floor of the platform (not pictured). Once in this position, the upper ring assembly supporting transport tubes 302 is preferably locked relative to the base pipe to prevent rotation thereof. An upper joint of the gravel packing apparatus, depicted as joint 304, may now be maneuvered into position above joint 300 using the hoisting apparatus of the well platform (not pictured). Joints 300 and 304 are now threadably connected to one another to form coupled joint, as best seen in FIG. 13B, which may be supported by the hoisting apparatus of the well platform (not pictured). As illustrated in FIG. 13B, upon making up the threaded connection, transport tubes 306 of joint 304 may not be axially aligned with transport tubes 302 of joint 300. In the present invention, the ring assemblies that receive and support transport tubes 306 are rotatable relative to the sand control screen such that the ring assemblies, the slurry delivery subassembly and the outer tubular of joint 304 may be rotated until transport tubes 306 of joint 304 are axially aligned with transport tubes 302 of joint 300, as best seen in FIG. 13C. Once in this position, the lower ring assembly supporting transport tubes 306 is preferably locked relative to the base pipe to prevent further rotation thereof. Once transport tubes 306 of joint 304 are locked and axially aligned with transport tubes 302 of joint 300, jumper tubes 308 may be coupled between transport tubes 306 of joint 304 and transport tubes 302 of joint 300, which establishes fluid communication therebetween and preferably a fluid tight seal therebetween. In this manner, the rotatably mounted slurry delivery subassemblies of the present invention enable assembly of the gravel packing apparatus of the present invention on the rig floor using a simple and efficient procedure.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for assembling a gravel packing apparatus, the method comprising:

providing first and second joints each including a sand control screen assembly having a filter medium positioned exteriorly of a base pipe and a slurry delivery subassembly rotatably mounted exteriorly on the sand control screen assembly, the slurry delivery subassembly including at least one transport tube extending longitudinally along at least a portion of the sand control screen assembly;

threadably coupling the sand control screen assembly of the first joint to the sand control screen assembly of the second joint;

after threadably coupling the sand control screen assembly of the first joint to the sand control screen assembly of the second joint, locking the slurry delivery subassembly of the second joint relative to the sand control screen of the second joint with a locking assembly of the second joint;

after locking the slurry delivery subassembly of the second joint relative to the sand control screen of the second joint, axially aligning the at least one transport tube of the first joint with the at least one transport tube of the second joint by rotating the slurry delivery subassembly of the first joint relative to the sand control screen of the first joint;

after axially aligning the at least one transport tube of the first joint with the at least one transport tube of the second joint, locking the slurry delivery subassembly of the first joint relative to the sand control screen of the first joint with a locking assembly of the first joint; and coupling at least one jumper tube between the at least one transport tube of the first joint and the at least one transport tube of the second joint.

2. The method as recited in claim 1 wherein rotating the slurry delivery subassembly of the first joint relative to the sand control screen of the first joint further comprises sliding first and second ring assemblies of the slurry delivery subassembly on first and second rails of the sand control screen assembly.

3. The method as recited in claim 1 wherein coupling the at least one jumper tube between the at least one transport tube of the first joint and the at least one transport tube of the second joint further comprises establishing fluid communication between the at least one transport tube of the first joint and the at least one transport tube of the second joint.

4. The method as recited in claim 1 wherein coupling the at least one jumper tube between the at least one transport tube of the first joint and the at least one transport tube of the second joint further comprises sealably coupling the at least one jumper tube between the at least one transport tube of the first joint and the at least one transport tube of the second joint.

* * * * *